United States Patent [19]

Cruickshank

[11] 4,067,472

[45] Jan. 10, 1978

[54] COMBINED ANTI-REFILLING AND POURING DEVICE FOR FITMENT TO A BOTTLE

[75] Inventor: Charles Burns Cruickshank, Glasgow, Scotland

[73] Assignee: Daniel Montgomery & Son Limited, Glasgow, Scotland

[21] Appl. No.: 783,404

[22] Filed: Mar. 31, 1977

[51] Int. Cl.[2] ..... B65D 49/06

[52] U.S. Cl. ..... 215/22

[58] Field of Search ..... 215/17, 18, 21, 22, 215/23, 26, 29

[56] References Cited

U.S. PATENT DOCUMENTS

| | | | |
|---|---|---|---|
| 657,459 | 9/1900 | Seelig | 215/23 |
| 2,046,340 | 7/1936 | McDonald | 215/22 |
| 2,077,026 | 4/1937 | Thornton | 215/21 |
| 2,184,468 | 12/1939 | Podel | 215/22 |
| 2,835,403 | 5/1958 | Scheminger | 215/22 |

*Primary Examiner*—Donald F. Norton

[57] ABSTRACT

A combined anti-refilling and pouring device for use in association with a bottle incorporates a tubular casing having at one end a tubular extension formed with inwardly directed radial fins and an annular flange presenting a center hole projecting inwardly beyond the fins at the outer end of the extension. A ring member having radially disposed fins extending axially from one end face of the ring is located within the tubular casing with the fins on the ring member terminating close to the fins in the tubular extension. A movable valve member is trapped within the axial passage defined by the tips of the radial fins in the tubular extension between the fins on the ring member and the annular flange, the valve member being free to engage the center hole and close it, and a ring of deformable material having a maximum diameter greater than the internal diameter of the neck of a bottle into which the device is to be fitted encircles the tubular casing.

2 Claims, 7 Drawing Figures

COMBINED ANTI-REFILLING AND POURING DEVICE FOR FITMENT TO A BOTTLE

The subject of this invention is a combined anti-refill fitment and pouring device for a bottle. Anti-refill fitments are used to prevent removal of the original contents of bottles bearing the brand labels of, for example, reputable manufacturers of spirits and replacement of the original contents by other material of an inferior quality with the intention of reselling the bottles as genuinely containing the product of the company mentioned on the brand label.

Such anti-refill fitments take the form of structures which are fitted over the necks of the bottles and once in place cannot be removed without being permanently damaged. A bottle which has been tampered with thus provides an indication that it has been tampered with. These fitments are all more or less complicated and expensive to make and it has been realized that the best type of fitment would be one which would fit within the bottle neck rather than outside the bottle neck. This idea has not been pursued because heretofore it had not been possible to provide such a fitment which would be virtually irremovable from the bottle neck.

All anti-refill devices as heretofore constructed suffer from the disadvantage that only a single channel is presented for the exit of liquid from the bottle fitted with the device. The result of this is that in the pouring position air attempting to enter the bottle to replace liquid leaving the bottle can enter the bottle only from the same passage as the liquid leaves the bottle. This causes surging because what happens is that the liquid in the bottle being denser takes precedence in leaving the bottle over the air attempting to enter the bottle so that liquid continues to flow out until the pressure within the bottle drops so much below atmospheric pressure that the ambient pressure is able to force air in against the out-flowing liquid thus stopping the flow of liquid, the flow of liquid remaining stopped until the pressure within and without the bottle are substantially equal whereupon the flow of liquid again resumes until the internal pressure drops again. This action causes splashing and sometimes difficulty in filling small receptacles.

It is an object of the present invention to provide a device combining anti-refill properties with good pouring characteristics and which can be fitted permanently within the neck of the bottle yet which is extremely difficult if not impossible to remove.

The usual bottle made to contain spirits carries a reinforcing ring around the outside of the neck. It has been noticed that the inside of the neck at the position of the ring on the outside is locally increased in diameter normally as part of the process of fitting the reinforcing ring and use is made of this fact for the purpose of the present invention.

A combined anti-refilling and pouring device according to the invention incorporates a tubular casing formed with a main body portion and a tubular extension projecting from one end of the main body portion, said tubular extension being formed with inwardly directed radial fins of a radial dimension such as to leave a clear axial passage through the tubular extension, and at the end remote from the main body portion with an annular flange projecting inwardly beyond the fins, a ring member consisting of a ring and fins extending axially from one end face of the ring, the fins being radially disposed with respect to the axis of the ring and the end portions of all the fins remote from the ring being connected to the periphery of a disc the diameter of which is less than the outside diameter of the ring, said ring member being located within the main body portion of the tubular casing with the fins on the ring member adjacent the fins in the tubular extension, at least one movable valve member located within the clear axial passage in the tubular extension and trapped between the fins on the ring member and the annular flange, and a ring of deformable material encircling the tubular casing, the maximum diameter of the ring of deformable material being greater than the internal diameter of the neck of a bottle into which the device is to be fitted.

The ring may be formed of cork or of a flexible plastics material such as one of the vinyl acetate compounds. The material is chosen such that it will not react with the liquid contents of the bottle.

The ring may be lenticular or may be arch-shaped in cross section. Alternatively it may be circular or elliptical in cross-section and may be hollow.

Since the invention makes use of the local increase in internal diameter the invention also consists in the combination of a bottle having a neck containing a portion of increased internal diameter and a tubular anti-refilling and pouring device containing a one-way valve and carrying a ring of flexible material encircling the tubular body member, the body member being inserted within the bottle neck with the ring of flexible material engaging the portion of increased internal diameter.

A practical embodiment of the invention is illustrated in the accompanying drawings in which FIG. 1 is a longitudinal section through an assembled device;

Figure 6:
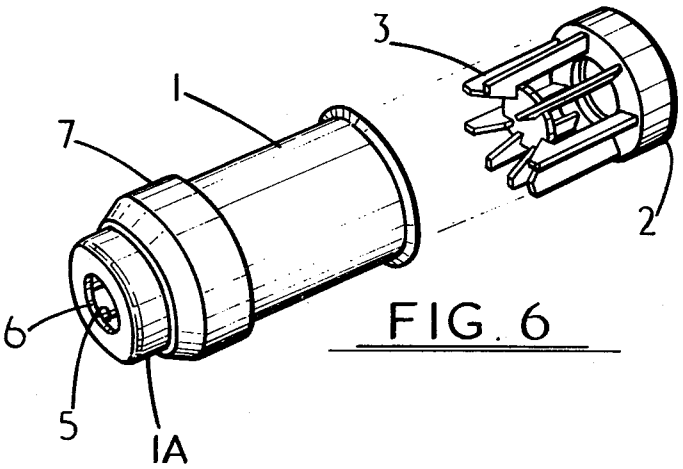
FIG. 6 is an exploded perspective view showing the parts making up the device withdrawn from one another.
Figure 7:
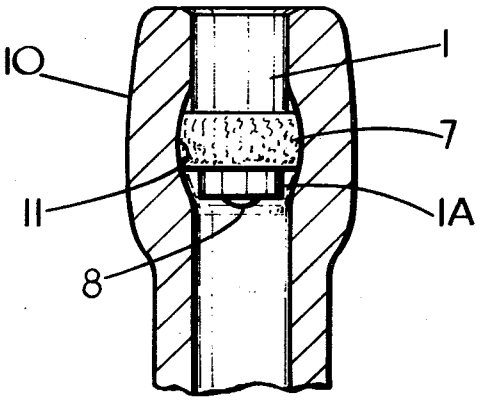
FIG. 7 is a longitudinal section of a bottle neck showing how the device is gripped therein.
Figure 3:
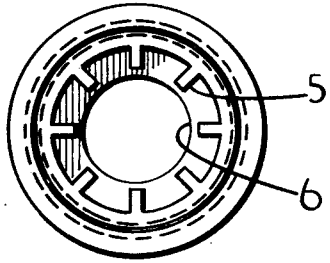
FIG. 3 is a view looking in the direction of the arrow A in FIG. 2.
Figure 4:
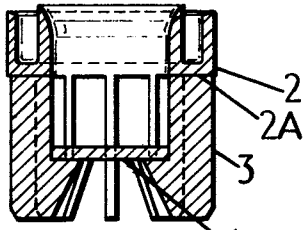
FIG. 4 is a longitudinal section of the ring member.
Figure 5:
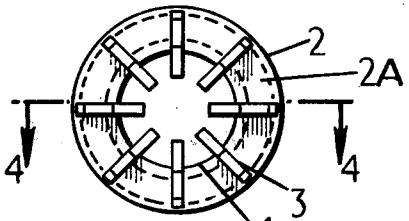
FIG. 5 is a view looking in the direction of the arrow B in FIG. 4, the longitudinal section as shown in FIG. 4 being taken through the line 4–4 in FIG. 5.
Figure 1:
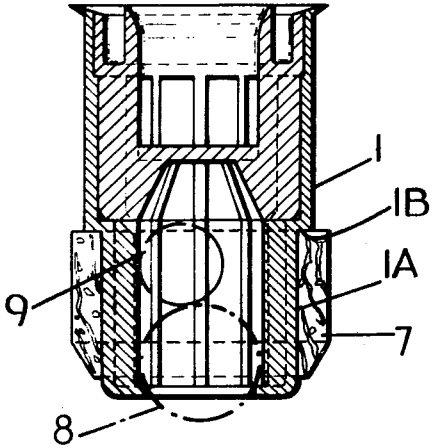
Figure 2:
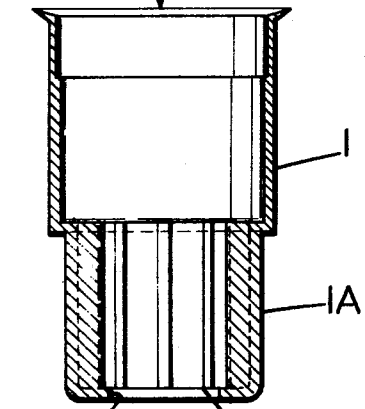
FIG. 2 is a longitudinal section of the casing.

In the drawings 1 denotes a tubular casing formed with a tubular extension 1A of smaller outside diameter than the main portion of the casing and connected thereto by a shoulder 1B. 2 denotes a ring member formed with fins 3 extending axially from the end face 2A of the ring 2, the fins being radially disposed with respect to the axis of the ring 2 as shown in FIG. 5 and their end portion remote from the ring member 2 being connected to the periphery of a disc 4 the diameter of which is less than the outside diameter of the ring member 2. The tubular casing 1 is formed with inwardly directed radial fins 5 as shown in FIG. 3, located within the extension 1A the outer end of which is formed with an inwardly directed flange 6. The radial fins have radial dimensions such as to leave a clear axial passage within the tubular extension. 7 denotes a resilient ring formed of cork fitted around the extension 1A and abutting against the shoulder 1B. 8 and 9 denote balls trapped within the clear axial passage in the tubular casing 1 between the flange 6 and the ring member 2, the larger ball 8 being adjacent the flange 6 and the smaller ball 9 being nearer the ring member 2. In FIG.

7, 10 denotes the neck of a bottle formed with a local increase in internal diameter indicated at 11.

To fit a bottle with an anti-refilling and pouring device according to the invention the device is entered into the neck 10 of the bottle, the deformable ring 7 being deformed in this action until it comes to the portion 11 of larger internal diameter whereupon the deformed ring 7 in trying to resume its original shape expands into the increased diameter portion 11 and thus locks the device into the bottle neck.

Once the device has been inserted and the flexible ring 7 expanded into the increased diameter portion 11 of the bottle neck 10 it is extremely difficult to dislodge the device because of the difficulty in obtaining a grip on the device to pull it out without damaging it. The operation is made more difficult still by the presence of the balls 8 and 9 in the tubular extension 1A. The balls provide an obstruction to any hooked object which might be inserted with the intention of engaging the far end of the device so that the device can be pulled out.

In use liquid may be poured from a bottle fitted with the device of the invention in any random position in which the bottle is picked up because no matter how the bottle is tilted always some of the fins 3 and 5 in both the ring 2 and the tubular casing 1, respectively, in what is at that instant the upper half of the tilted bottle neck and the channels between these fins are at the top of the tilted bottle neck while other channels are present between the fins projecting downwardly in what is at that same instant the lower half of the tilted bottle neck. The channels at the top serve as air vents permitting free entry of air at the same time as liquid flows out through the lowermost channels and past the balls 8 and 9. The disc 4 prevents mixing of air and liquid because it acts to reduce the velocity of liquid attempting to leave the bottle so that the gravitational effect on the liquid is sufficient to keep it in the lowermost part of the pouring device thus leaving the upper part of the pouring device free for entry of air. The balls 8 and 9 do not impede the pouring operation because when the bottle is tilted to pour the contents they rest against the disc 4 and the fins 3 and 5. The use of two balls of different diameters assists in ensuring that there is adequate room for the free flow of liquid through the ring member 2. The smaller ball 8 holds the larger ball 9 away from the ring member 2.

Before any attempt can be made to refill an emptied bottle fitted with the device the bottle must be placed upright. In this position the balls 8 and 9 drop into their lowermost position. In this position the large ball 8 engages the flange 6 which thus functions as a valve seat and forms with it a closed ball valve effectively preventing liquid from entering the bottle. The ball 8 cannot be pushed aside to allow liquid to pass because the disc 4 prevents access to the ball.

What is claimed is:

1. A combined anti-refilling and pouring device incorporating a tubular casing formed with a main body portion and a tubular extension projecting from one end of the main body portion, said tubular extension being formed with inwardly directed radial fins of a radial dimension such as to leave a clear axial passage through the tubular extension, and at the end remote from the main body portion with an annular flange projecting inwardly beyond the fins, a ring member consisting of a ring and fins expanding axially from one end face of the ring, the fins being radially disposed with respect to the axis of the ring and the end portions of all the fins remote from the ring being connected to the periphery of a disc the diameter of which is less than the outside diameter of the ring, said ring member being located within the main body portion of the tubular casing with the fins on the ring member adjacent the fins in the tubular extension, at least one movable valve member located within the clear axial passage in the tubular extension and trapped between the fins on the ring member and the annular flange, and a ring of deformable material encircling the tubular casing, the maximum diameter of the ring of deformable material being greater than the internal diameter of the neck of a bottle into which the device is to be fitted.

2. A combined anti-refilling and pouring device as claimed in claim 1 in combination with a bottle having a neck containing a portion of increased internal diameter, the tubular casing containing the ring member being located within the bottle neck with the ring of flexible material engaging the portion of the bottle neck of increased internal diameter.

* * * * *